US007942213B2

(12) United States Patent
Sihler

(10) Patent No.: US 7,942,213 B2
(45) Date of Patent: May 17, 2011

(54) USING HYDROSTATIC BEARINGS FOR DOWNHOLE APPLICATIONS

(75) Inventor: Joachim Sihler, Somerville, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 443 days.

(21) Appl. No.: 11/553,876

(22) Filed: Oct. 27, 2006

(65) Prior Publication Data

US 2008/0099246 A1 May 1, 2008

(51) Int. Cl.
*E21B 7/04* (2006.01)

(52) U.S. Cl. ..... 175/61; 175/76

(58) Field of Classification Search ..... 175/61, 175/73, 76; 384/110
See application file for complete search history.

(56) References Cited

U.S. PATENT DOCUMENTS

| | | | | |
|---|---|---|---|---|
| 4,767,223 | A * | 8/1988 | Goodwin | 384/114 |
| 5,068,554 | A * | 11/1991 | Mohn | 310/12 |
| 5,099,934 | A * | 3/1992 | Barr | 175/393 |
| 5,111,892 | A | 5/1992 | Sinor et al. | |
| 5,553,678 | A * | 9/1996 | Barr et al. | 175/73 |
| 6,341,656 | B1 | 1/2002 | Fanuel et al. | |

FOREIGN PATENT DOCUMENTS

| | | |
|---|---|---|
| EP | 0435447 A1 | 7/1991 |
| GB | 2259316 A | 3/1993 |

OTHER PUBLICATIONS

Website Printout entitled "Drill String Torque Reducer" from http//www.pdc-uk.com/products/dstr by Pilot Drilling Control ltd, Nouvotech House, Harbour Road Ind. Est., Lowestoft, Suffolk, NR32 3LZ, UK.

Website Printout entttled "Spiro-Torq®" from http://www.drilltech.com/spirotorq.htm by Drilltech House, Greenwell Road, East Tullos, Aberdeen, AB12 3AX, Scotland, UK.

Fuller et al., "Improved Means of Reducing Drag in ERD Applications", SPE 76759, May 20-22, 2002.

Boulet et al., Improved Hole Cleaning and Reduced Rotary Torque by New External Profile on Drilling Equipment, IADC/SPE 59143, Feb. 23-25, 2000.

Slocum., "Precision Machine Design", Chapter 9 entitled "Bearings without Mechanical Contact Between Elements", pp. 551-580, SME, Prentice-Hall, Inc. 1992.

* cited by examiner

*Primary Examiner* — William P Neuder
*Assistant Examiner* — Nicole A Coy
(74) *Attorney, Agent, or Firm* — Jeremy Welch; Brigitte Echols

(57) ABSTRACT

Hydrostatic bearings are used for drill string stabilization and bottom hole assembly steering. The hydrostatic bearings utilize an existing mud flow as the bearing fluid. For steering, the bearings may be used between movable kick pads and the formation to reduce friction. Alternatively, differential hydrostatic bearing pressure may be utilized to steer. Multi-modal (non-linear and linear) steering may be provided by selectively applying equal and unequal hydrostatic bearing pressures. The bearings can be made more tolerant of imperfections in the formation by utilizing multiple pressure pockets.

25 Claims, 10 Drawing Sheets

POROUS RESTRICTOR BEARING 800

USING HYDROSTATIC BEARINGS FOR DOWNHOLE APPLICATIONS

FIELD OF THE INVENTION

This invention relates generally to the field of well drilling, and more particularly to drill string stabilization and bottom hole assembly steering.

BACKGROUND OF THE INVENTION

The depth of oil wells drilled with current technology can reach tens of thousands of feet. The wells may be non-linear in order to increase exposure to the production zone. Maximum depth is limited by the mechanical strength of the drill pipe. In particular, the depth is limited by the capability of the drill pipe to withstand the compressive, tensile, torsional, bending, and pressure differential forces required to create the borehole. The pipe is subjected to torsional forces due to the torque required to overcome both friction against the formation and the torque to rotate the drill bit. The decrease of torsional stiffness due to the extended length of the drill string in deep wells and the friction against the formation can even cause stick-slip effects which, in extreme cases, can lead to self-unscrewing of drill pipe joints, drill bit damage, BHA vibration, and other undesirable results. In cases where surface or intermediate casings are already in place, friction between casing and drill string can wear through the casings at the pressure points of bends, resulting in either formation fluids entering the well or lost circulation. Extensive forces of the drill pipe against the mud cake wall can lead to differential sticking and loss of equipment.

It is known to reduce drill string friction by using stabilizer subs having a non-rotating sleeve. The bearing surface between the sleeve and the drill pipe includes a set of sliding or rolling element bearings. While such stabilizer subs reduce friction, they are relatively complex and costly. Because of the complexity, such stabilizer subs are more likely to fail than simpler devices. Ball bearing packages, for example, are particularly subject to degradation and failure in a borehole environment. Non-rotating sleeves are also problematic when they become jammed against the formation downhole because the bearings themselves inhibit the use of torsionally applied force to free the sleeve. The overall cost of use of such subs can be considerable because it is a multiple of stabilizer sub unit cost and the number of required subs. On a 30,000 ft drill string, 500 such stabilizer subs would be needed if they were used every 60 ft.

Another way of reducing drill string friction is described by J. G. Boulet, J. A. Shepherd, J. Batham: *Improved Hole Cleaning and Reduced Rotary Torque by New External Profile on Drilling Equipment*, IADC/SPE Drilling Conference, New Orleans, La. No. 59143, February 2000 ("Boulet"), herein incorporated by reference in its entirety. According to Boulet, an external drill string sub profile includes a hydrodynamic bearing. This bearing provides a film of pressurized fluid between the drill string and the borehole. However, the shape of the hydrodynamic sub requires very complex and expensive machining, rendering this solution uneconomical and impractical with current manufacturing techniques. Furthermore, the Boulet hydrodynamic sub design only reduces friction when the drill string is rotating, and thus it will not provide assistance for restarting rotation after a new joint of drill pipe has been added at the surface.

SUMMARY OF THE INVENTION

In accordance with one embodiment of the invention, apparatus for facilitating drilling operations includes a drillstring segment adapted to be inserted into a borehole, and including a cavity capable of carrying a pressurized fluid, the drillstring segment including at least one hydrostatic bearing feature capable of retaining the pressurized fluid to provide a film of fluid between the hydrostatic bearing and a bearing surface such as a subterranean formation or casing.

In accordance with another embodiment of the invention, apparatus for facilitating steerable drilling of a borehole includes a bottom hole assembly including a drill bit and a body having a cavity capable of carrying a pressurized fluid, the bottom hole assembly including at least one hydrostatic bearing capable of utilizing the pressurized fluid to provide a film of fluid between the hydrostatic bearing and a bearing surface.

In accordance with another embodiment of the invention, a method for facilitating drilling operations includes the steps of providing a film of fluid between a bearing surface and at least one hydrostatic bearing of a drillstring segment which includes a cavity capable of carrying a pressurized fluid and which is adapted to be inserted into a borehole, by directing at least some of the pressurized fluid to the hydrostatic bearing.

In accordance with another embodiment of the invention, a method for facilitating steerable drilling of a borehole comprising the steps of: with a bottom hole assembly including a drill bit and a body having a cavity capable of carrying a pressurized fluid, the bottom hole assembly including at least one hydrostatic bearing, utilizing the pressurized fluid to provide a film of fluid between the hydrostatic bearing and a bearing surface. In particular, one or more hydrostatic bearings can be operated at substantially equal pressure in order to drill a linear borehole, and a subset of the bearings can be operated under relatively greater pressure than other bearings, in a time-varying manner, to provide a side force in order to drill a non-linear borehole.

Use of hydrostatic bearings for downhole applications offers advantages over previous techniques. For example, hydrostatic bearings in stabilizer subs and steering assemblies provide low wear, low friction, high load capacity and simple, reliable design. Further, the pressure differential between the inside and the outside of the drill pipe can be used as a source of power to drive the hydrostatic bearings. Further, multi-pocket bearings can be utilized to enhance tolerance of surface imperfections in the formation.

BRIEF DESCRIPTION OF THE FIGURES

FIG. 16 is a cross-sectional view of the drill bit of FIG. 15 taken along B-B.

DETAILED DESCRIPTION

Figure 1:
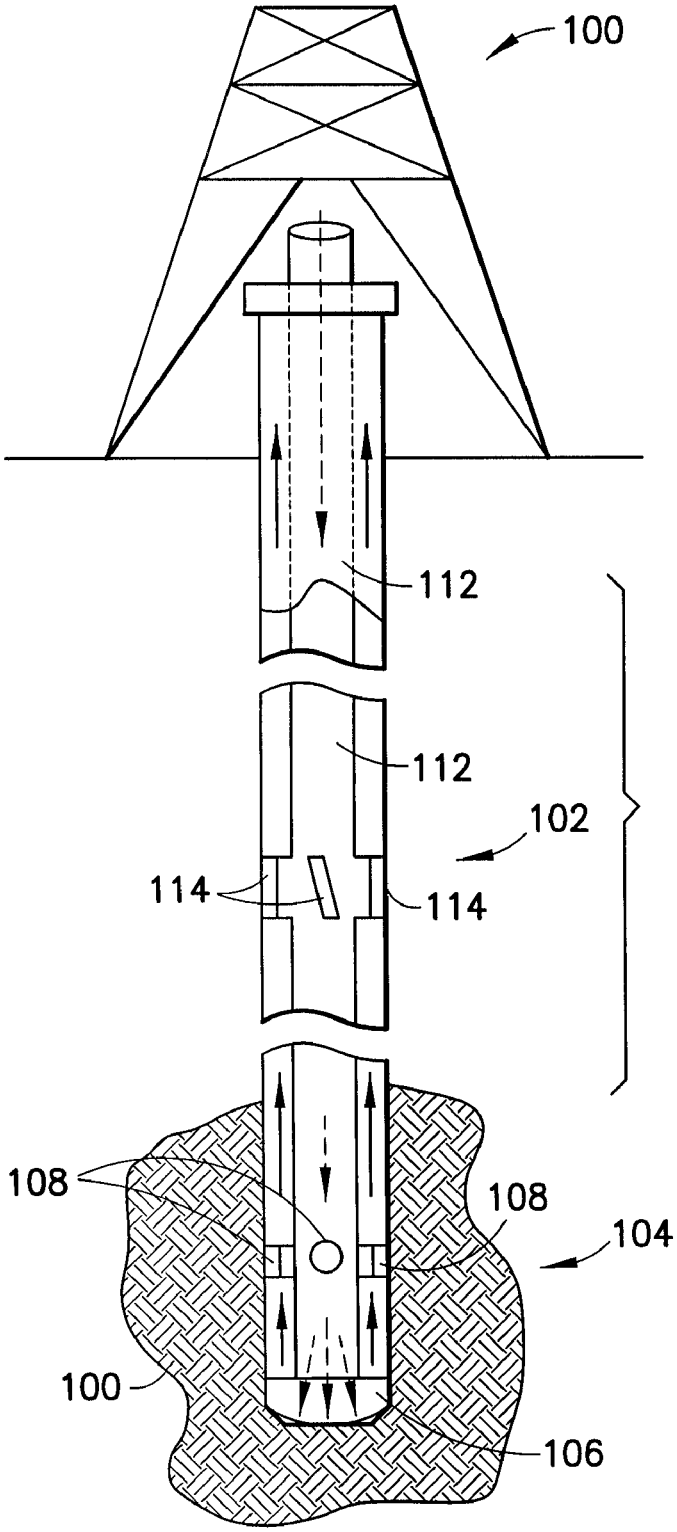
FIG. 1 illustrates elements of a well drilling rig.

FIG. 1 illustrates a well drilling rig. The drilling rig includes a surface assembly (100), multiple stabilizer subs, of which stabilizer sub (102) is exemplary, and a bottom hole assembly ("BHA") (104). The non-stationary sub-surface components of the drilling rig such as the drill pipe (112), stabilizer subs (102) and BHA (104) are typically referred to as the "drill string." The BHA includes a drill bit (106) and at least one steering component (108), which may be disposed in the drill bit or higher on the BHA. The drill bit is operable to abrade the formation (110) in order to form a borehole. In particular, the drill bit forms a borehole having a greater diameter than the drill pipe (112) which makes up the majority of the length of the drill string.

In order to operate efficiently, the cuttings created by the drill bit are removed from the borehole by forcing highly pressurized water ("mud flow") through openings in the drill bit, thereby forcing the cuttings to the surface in an annular mud return flow that is outside the drill string but within the borehole. The return mud flow may then be filtered in order to separate the cuttings, and the resulting mud re-used for circulation. In order to drive the mud flow and bring the cuttings to the surface, the mud flow pressure inside the drill string is greater than the mud pressure outside the drill string.

Steering is accomplished by generating a force between a selected section of the BHA and the formation. Typically, the BHA is rotated during drilling. In one embodiment where multiple circumferential steering components (108) are included, only one component (108) is activated at any given time in order to steer while drilling. In the case where a single steering component (108) is included, that single component is periodically activated as the BHA rotates. The result, in either case, is generation of a relative imbalance of force, a.k.a., a side force, between the BHA and different portions of the formation. The application of side force during drilling results in a deviated borehole. The BHA will also include orientation sensors which are used to provide a geostationary reference and to coordinate activation of steering components to achieve a desired result in the trajectory of the borehole, i.e., to steer in a desired direction.

The stabilizer sub (102) mitigates the possibility of damage to the drill string from contact with the formation. Multiple stabilizer sub components (114) define a diameter that is greater than the drill pipe, or drill string. Consequently, the stabilizer sub components prevent or at least mitigate the possibility of proximate segments of the drill string from contacting the formation. The drill string will typically include multiple stabilizer subs which may be spaced apart equidistantly along the drill string.

One aspect of the invention is the use of hydrostatic bearings to enhance performance of various components of the drilling rig. In particular, hydrostatic bearings can be utilized to reduce friction in the stabilizer subs to provide an inherent dampening rotational support due to the squeeze-file effect, or to provide steering force for the BHA and drill bit. However, before describing embodiments of those drilling rig enhancements it is appropriate to describe several embodiments of hydrostatic bearings which may be utilized for downhole applications.

Figure 2:
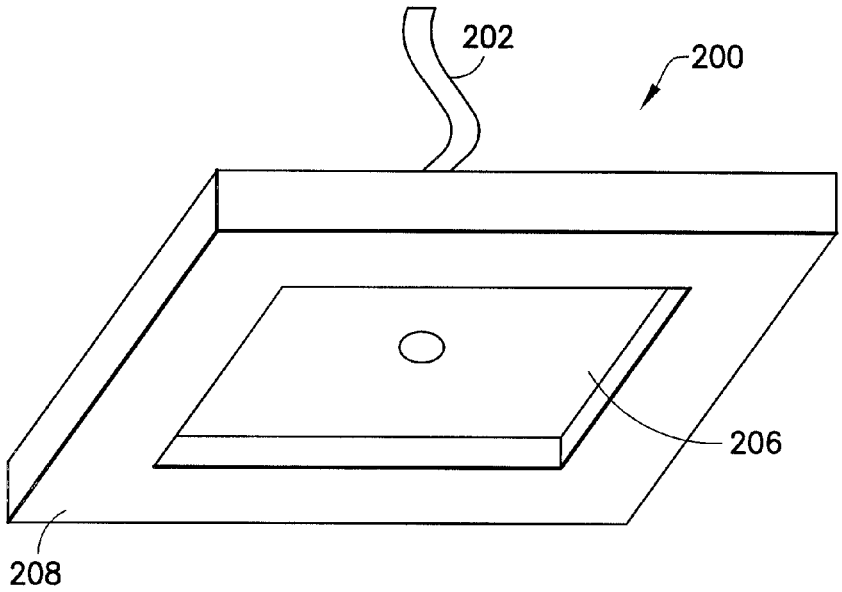
FIGS. 2 and 3 illustrate a single-pocket hydrostatic bearing.
Figure 3:
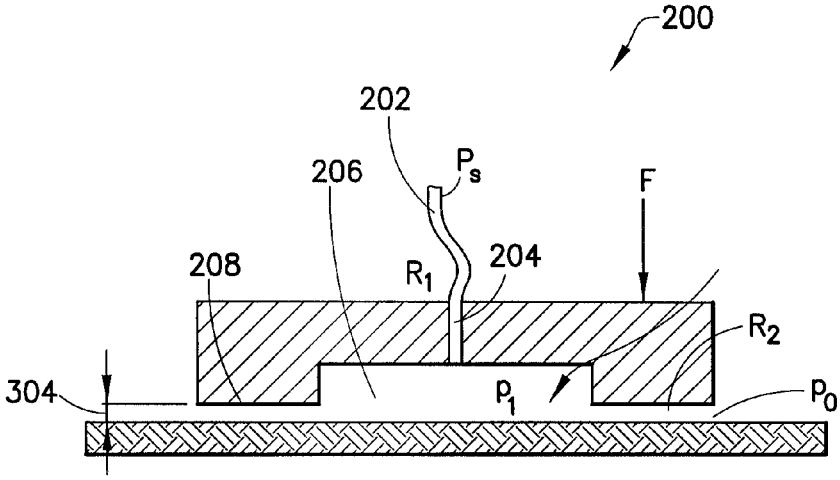

FIGS. 2 and 3 illustrate a single-pocket hydrostatic bearing (200). The single-pocket hydrostatic bearing includes a supply line (202) with supply pressure $p_s$, a flow restrictor (204) with resistance $R_1$, a bearing pressure pocket (206) with pocket pressure $p_1$, and a bearing land (208) which forms a thin gap (Resistance $R_2$) with a bearing surface (210), which in the illustrated example is the formation wall or casing. The bearing advantageously has a high load capacity. For example, a bearing with a pocket pressure of 500 psi and an area of 2"×2" could potentially support a load of more than 2000 lbs. This capacity is potentially enough to support and suspend bent and horizontal sections of drill pipe in directional wells. Further, the mud flow pressure differential between the interior and exterior of the drill string can be sufficient to enable operation of the hydrostatic bearing. Specific uses for the bearing will be described below.

Figure 4:
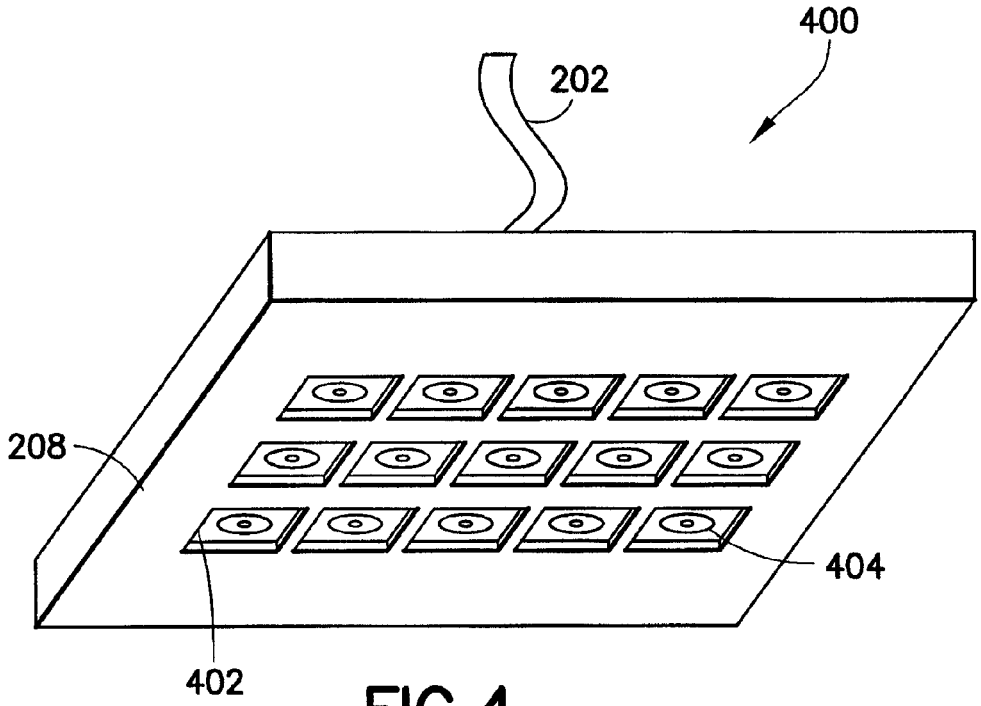
FIGS. 4 and 5 illustrate a multi-pocket hydrostatic bearing.
Figure 5:
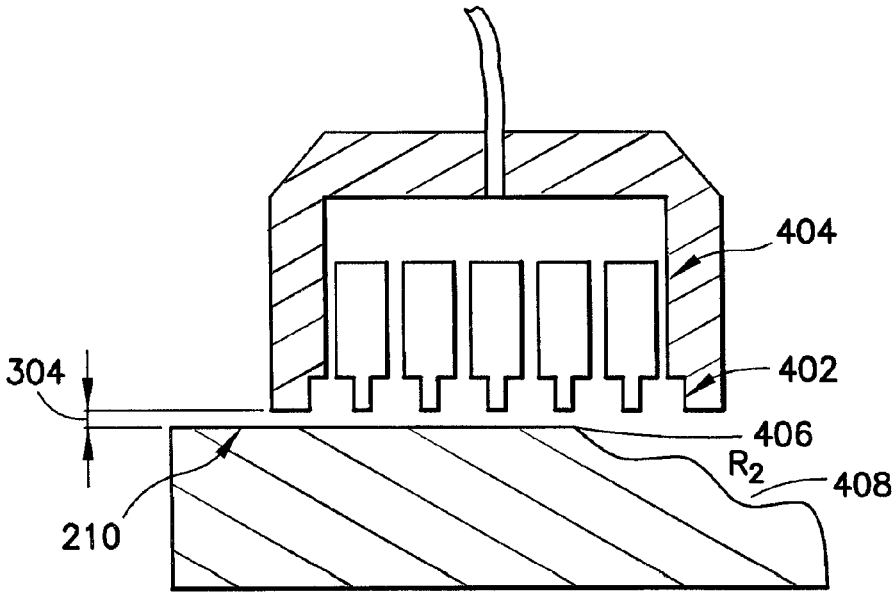

FIGS. 4 and 5 illustrate a multi-pocket hydrostatic bearing (400). Instead of a single pressure pocket, an array of smaller pressure pockets (402) are utilized. Individual pressure pockets of the array are at least partially independent. In particular, each pocket has a separate restrictor (404). The restrictors terminate in a common gap (406). Because the individual pressure pockets are at least partially independent, the multi-pocket bearing is less sensitive to imperfections (408) in the bearing surface (210). For example, when drilling into rock there is a relatively high probability for cracks and washouts to be encountered in the borehole wall. Such imperfections tend to temporarily increase parts of the gap (406), or otherwise compromise the pressure differential across the land by decreasing the fluidic resistance $R_2$. With a single pocket design, the pressurized fluid can escape more readily through the enlarged gap (304, FIG. 3) such that the pressure pocket looses pressure and the bearing loses its entire load capacity when a sufficiently large surface crack is encountered. However, with a multi-pocket bearing the loss of load capacity is limited to the bearing section located directly over the imperfection (408), i.e., to the individual pockets subjected to the enlarged gap. The pockets which are not over the imperfection are relatively unaffected, and still able to carry load.

Figure 6:
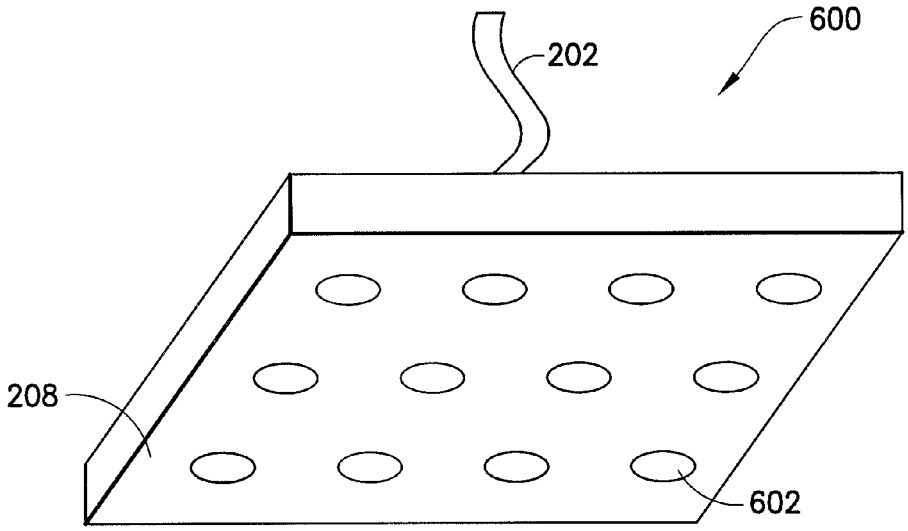
FIGS. 6 and 7 illustrate a multi-pocket hydrostatic bearing where the restrictor diameter is equal to the pocket diameter.
Figure 7:
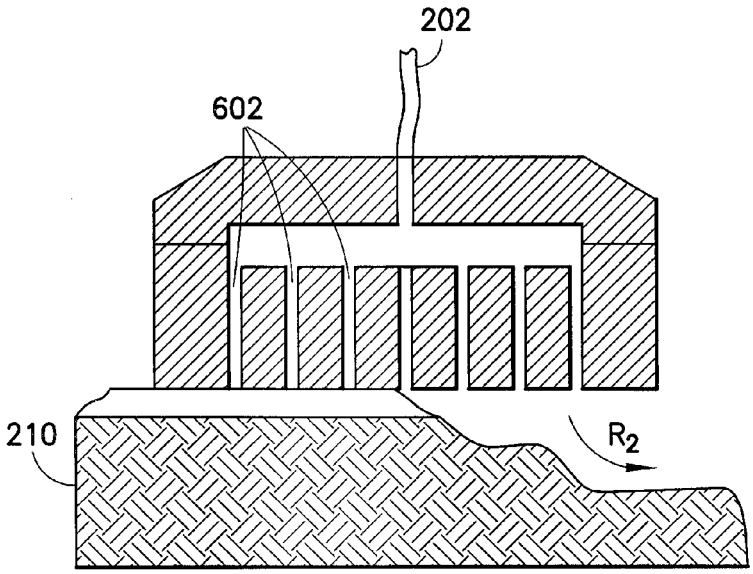

FIGS. 6 and 7 illustrate a multi-pocket hydrostatic bearing (600) where the restrictor diameter is equal to the pocket diameter (collectively (602). While this embodiment appears to be pocket-less because the pockets are not clearly differentiated from the restrictors, the bearing can be modeled as a multi-pocket bearing where restrictor diameter is equal to pocket diameter. As with the previously described embodiment, an array of small pressure pockets (602) are utilized, and individual pressure pockets of the array are at least partially independent. Because the individual pressure pockets are at least partially independent, the multi-pocket bearing is less sensitive to imperfections in the bearing surface (210).

Figure 8:
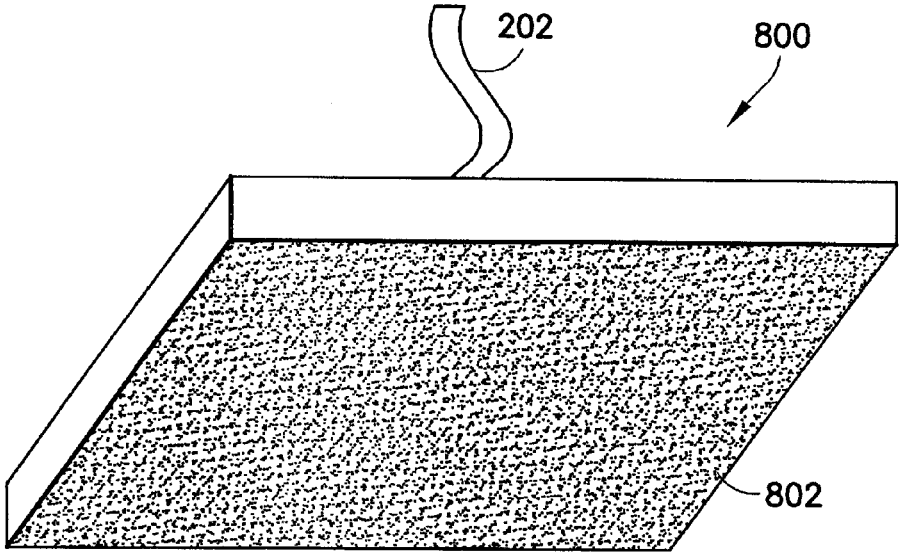
FIGS. 8 and 9 illustrate a porous restrictor hydrostatic bearing.
Figure 9:
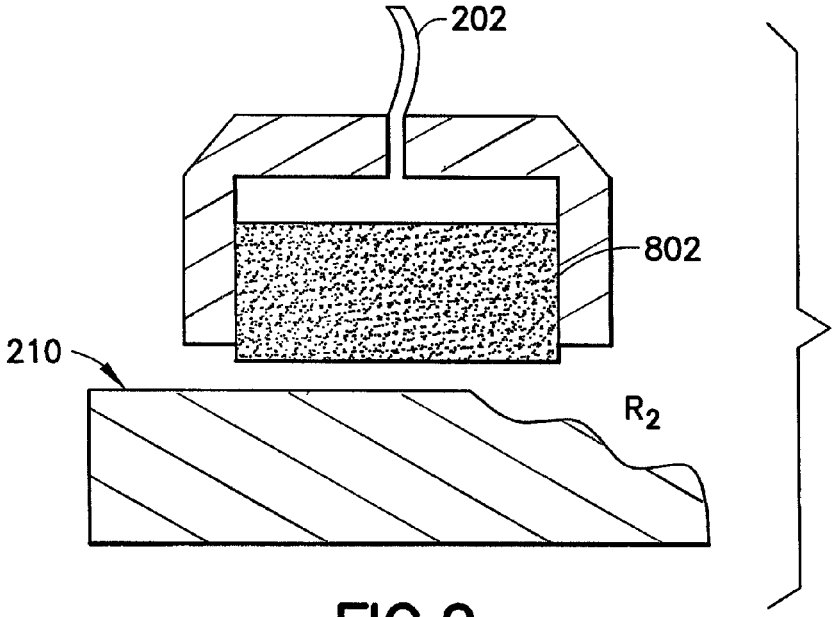

FIGS. 8 and 9 illustrate a porous restrictor hydrostatic bearing (800). In this embodiment a porous material (802) is used in lieu of the restrictors and pockets. Because the material is porous, a great many paths which act as restrictors are presented for the fluid to move from the supply to the gap between the bearing and the formation. The embodiment may therefore still be considered an extreme case of a multi-pocket bearing.

Referring to FIGS. 2 through 9, the mechanical properties of both the single pocket and multi-pocket bearings are determined by the fluidic resistance of the restrictor (202), the size of the bearing pocket or bearing pockets, and the gap (304) between the bearing land and the surface. For borehole applications there are certain boundary conditions for the mechanical design of such devices. If drilling mud is used as the bearing fluid, the system has to be robust enough to cope with a given particle size. Preferably the particle size limitation can be accommodated by an optional mud filtration system. For reliably smooth operation, the restrictor and the bearing land gap should be larger than the particle size to reduce the likelihood of clogging. Furthermore, in order to reduce the possibility of rubbing of the bearing pads against the surface, the bearing gap or floating height should be larger than the surface roughness of the borehole wall. The design of a hydrostatic bearing supported device will also have to take into account the mud circulation so that some of the annular area is given to the mud flow for transport of the rock cuttings from the drill bit. Multi-pocket hydrostatic bearings may be less sensitive to damage through wear/abrasion because if some of the bearing pad material is worn off by rubbing against the borehole wall, the only effect will be a slight reduction in the length of the restrictor holes. As this will only have a linear influence on the fluidic resistance of the restrictors, it is likely tolerable and will not diminish the function of the bearings.

Figure 10:
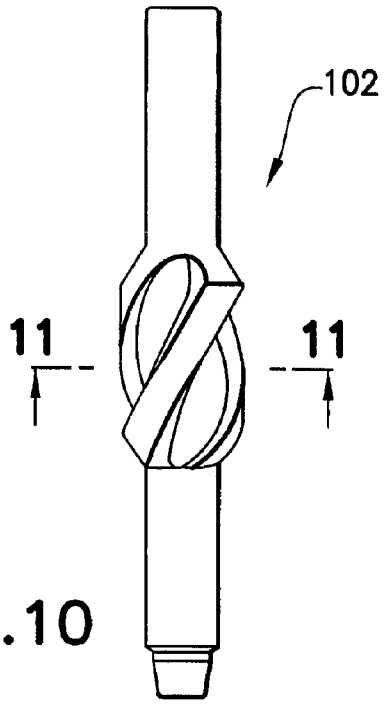
FIG. 10 illustrates the stabilizer sub of the drilling rig in greater detail.
Figure 11:
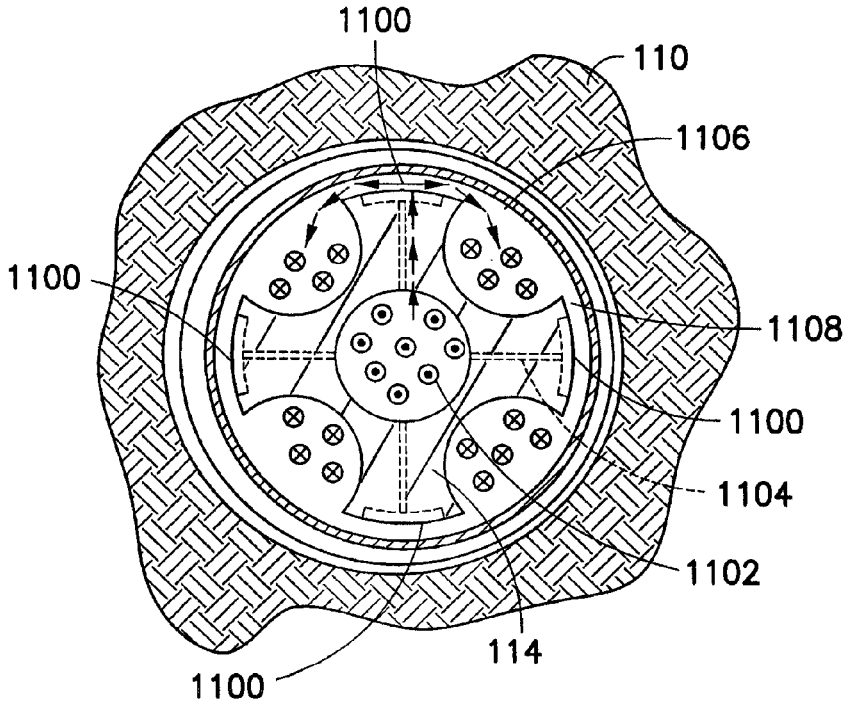
FIG. 11 illustrates a cross-sectional view of the hydrostatic bearings in the stabilizer sub of FIG. 10 taken along 10-10.

Referring now to FIGS. 1, 10 and 11, single pocket and multi-pocket hydrostatic bearings can be utilized as part of the outside surface of the drill string and as part of a stabilizer sub (102). In the illustrated example, which shows single pocket bearings for simplicity, four bearing pockets (1100) are fed by the drill mud that flows through the center of the stabilizer ("central mud flow") (1102). In particular, the fluid is fed into the bearing pocket through restrictors (1104) which are integrated into the stabilizer ribs. Either the formation (110) itself or the inside surface of intermediate casing (1106) provide the support surface against which the bearings can run. The friction against the casing is reduced because the stabilizer component will glide on a film of pressurized mud formed by the bearing pocket (1100) and bearing land (1108), rather than the bare metal surface. Consequently, the friction and the wear on the casing as well as the stabilizer sub will be reduced. The bearings may be particularly useful at the stage where the production section is drilled because the drill string is then at its longest and the thinnest, and needs the greatest amount of support and friction reduction.

Figure 12:
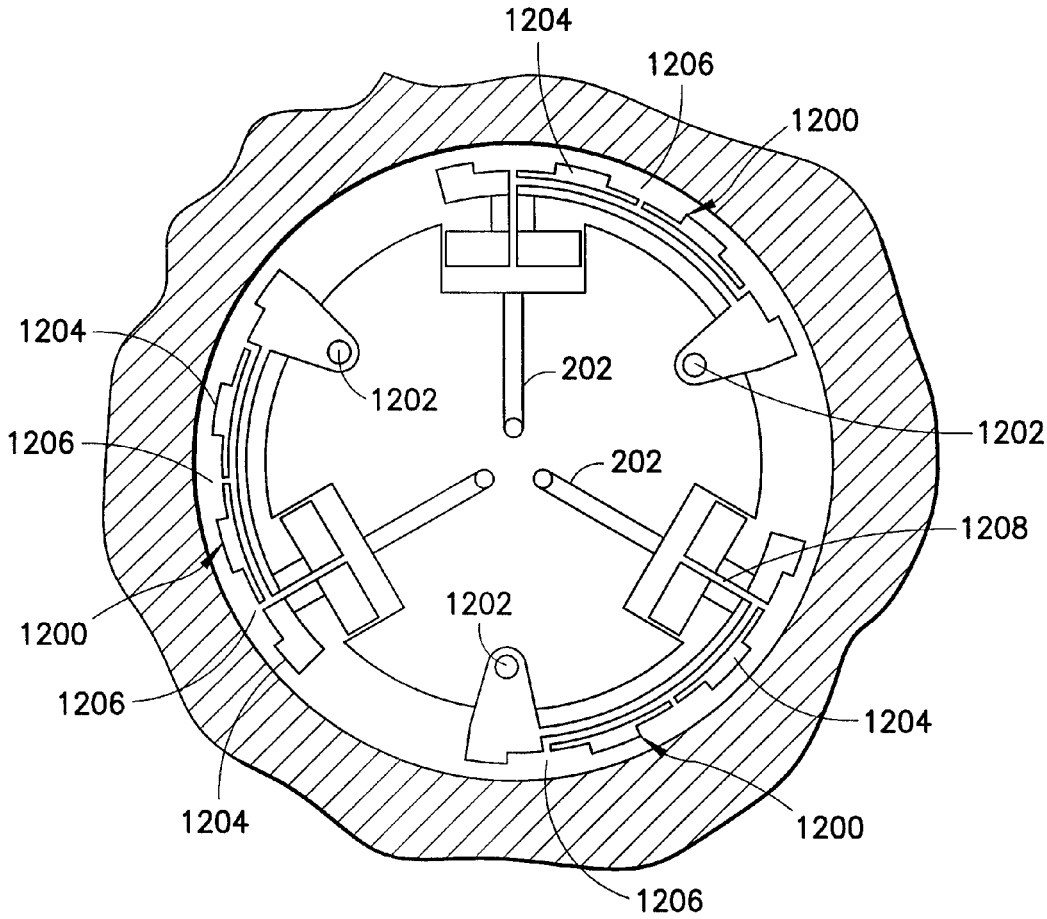
FIG. 12 illustrates use of hydrostatic bearings in steering kick-pads in the BHA of the drilling rig of FIG. 1 taken along A-A.

Referring now to FIGS. 1 and 12, single pocket and multi-pocket hydrostatic bearings may also be used to reduce friction in rotary steerable systems. In this embodiment the steering components (108) include hydraulically actuated kickpads (1200) which are operable to push the front of the BHA (104) into a prescribed direction, i.e., a "push-the-bit" system. Each kickpad (1200) pivots about a hinge (1202) and has an angular range of motion defined by an arc in a plane that is perpendicular to the axis defined by the BHA. The kickpads rotate with the drill string and are actuated in a coordinated manner in order to produce a relatively greater force into a selected direction mostly perpendicular to the drilling direction in order to steer the BHA. Friction between the formation and the kickpads is reduced because the bearings lands (1204) and bearing pockets (1206), particularly when providing steering force, maintain a pressurized fluid film between the kickpad and the formation. As already mentioned, the pressurized fluid used for operating the hydrostatic bearings may be the same fluid used to actuate the kickpads, e.g., the central mud flow.

Figure 13:
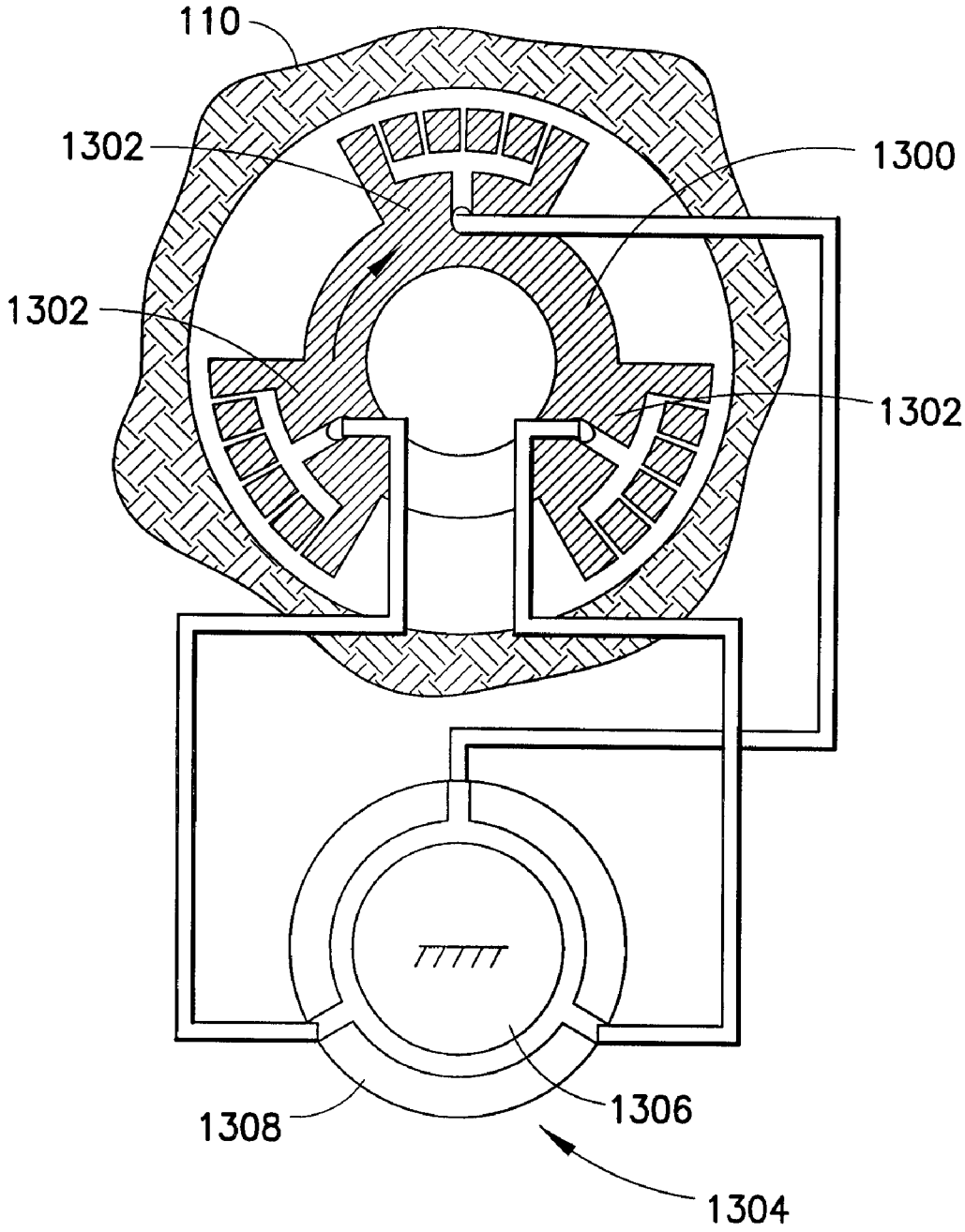
FIGS. 13 and 14 illustrate a hydrostatically biased steering system.
Figure 14:
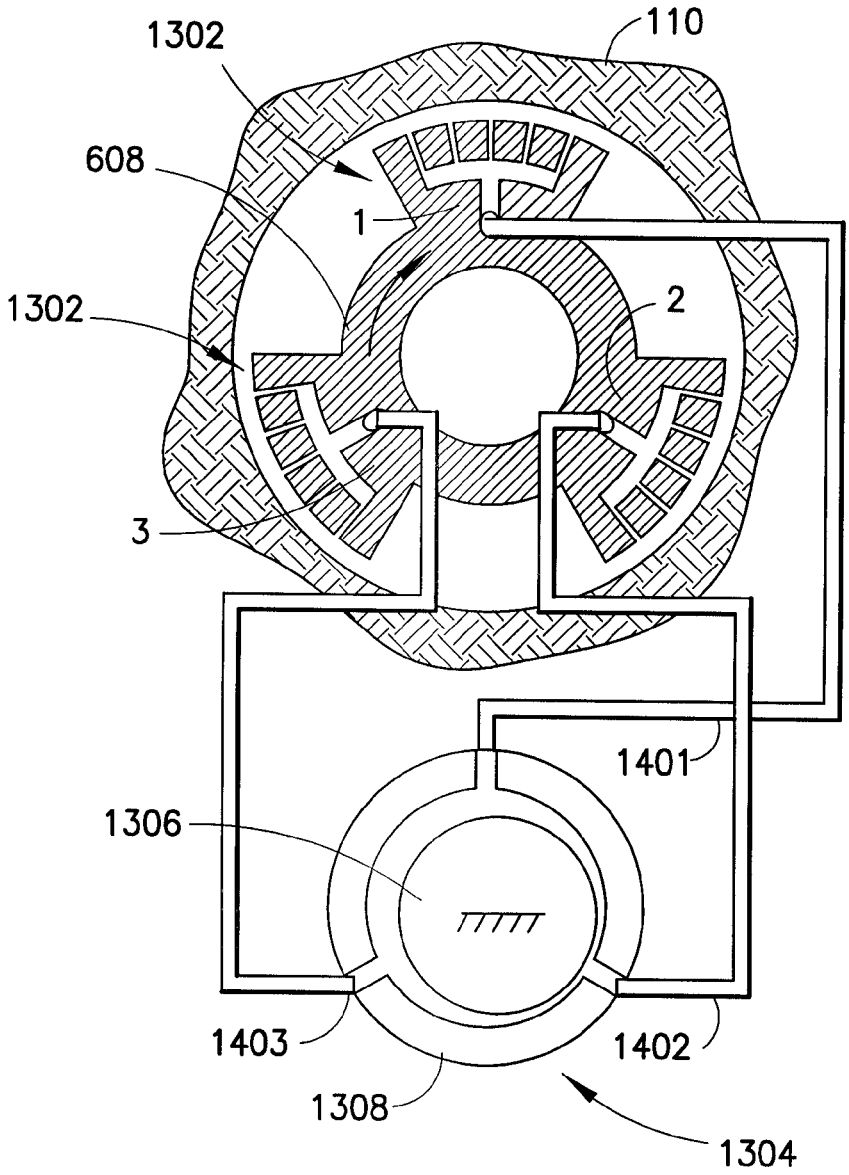

FIGS. 13 and 14 illustrate a hydrostatically biased steering system. The hydrostatically biased steering system (1300) utilizes variable hydrostatic force to steer the BHA rather than movable kick pads. The steering components (1302) do not move relative to the BHA. Rather, the steering components are hydrostatic bearings (multi-pocket bearings in the illustrated example, but single pocket bearings could be used) adapted to apply different force relative to one another against the formation (110) by varying the hydrostatic pressure in the pressure pockets of the hydrostatic bearings.

Varying the hydrostatic pressure may be accomplished by supplying the bearings with the bearing fluid through a variable flow restrictor unit (1304). In this example, the variable flow restrictor unit includes a restrictor rod (1306) that can be eccentrically displaced inside an outer cylinder (1308) with three radially drilled holes that are each fluidically connected to their corresponding bearing pads. The radially drilled holes are equidistant relative to one another. The restrictor rod is oriented along an axis parallel with the axis defined by the outer cylinder, such that the volume of fluid flow space between the rod and any given section of the outer cylinder is dependent upon and varies with rotation of the outer cylinder relative to the restrictor rod. The difference in fluid flow space volume causes a difference in fluidic resistance. In operation, the cylindrical part of the variable flow restrictor unit is held eccentric and geostationary while the restrictor rod part rotates with the bias unit. Due to the geometry, the fluidic resistance applied to each bearing varies smoothly and continuously during each rotation, thereby providing smoother steering. Non-linearity in the resistance or adjustments in the steering behaviour (dynamic) can be reduced or eliminated by modifying the circular shape of the cylindrical part, i.e., making the radius of the cylinder an appropriate function of the circumferential angle. In an alternative embodiment, independently operable valves are employed rather than the variable flow restrictor unit.

It should be appreciated that the hydrostatically biased steering system (1300) may be multi-modal, i.e., capable of both directional and linear steering. Multi-modal operation is accomplished by moving the position of the restrictor rod (1306) axis relative to the outer cylinder (1308) axis. When the restrictor is in the center of the outer cylinder, i.e., when the restrictor rod and outer cylinder are oriented in the same axis, the flow resistance and thus the bearing pad pressure is equal on all bearings. Consequently, the same pressure is applied to each bearing surface, and the BHA will tend to drill along a linear path. When the cylinder axis is displaced relative to the restrictor rod axis as illustrated, the flow resistance of restrictor (1402) is higher than that of restrictors (1401) and (1403). Consequently, the line pressure leading to the bearing pad supplied by restrictor (1402) is lower than that associated with restrictors (1401) and (1403). This results in an imbalance of force against the bearing surface which is used for non-linear steering in a similar manner to that already described above. To maintain equilibrium, the bias unit will be displaced inside the borehole in the direction of the lowest pressure bearing pad, which in this case is the bearing pad associated with restrictor (1402). A system like this can create a strong bias force while exhibiting extremely low friction and wear.

In the illustrated example, the hydrostatic bias unit is shown with three bearing pads and a 3-way restrictor unit. However, the bias unit can have any number of bearing pads, including but not limited to a single bearing pad and more than three bearing pads for smoother circumferential transition. Even a continuous system without distinct pads may be utilized.

Figure 15:
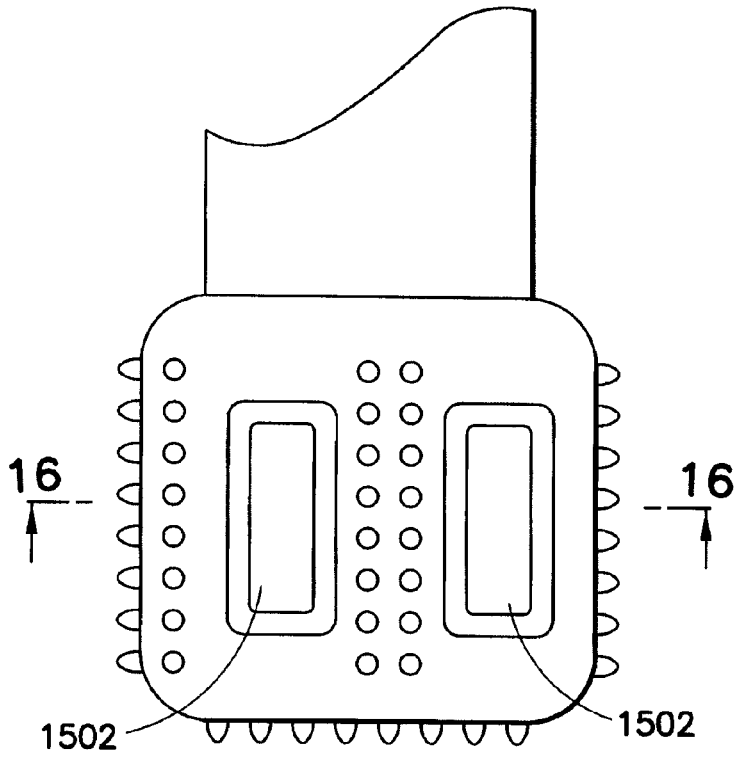
FIGS. 15 and 16 illustrate a drill bit with hydrostatic pressure pockets which operate as a bias steering feature, where
Figure 16:
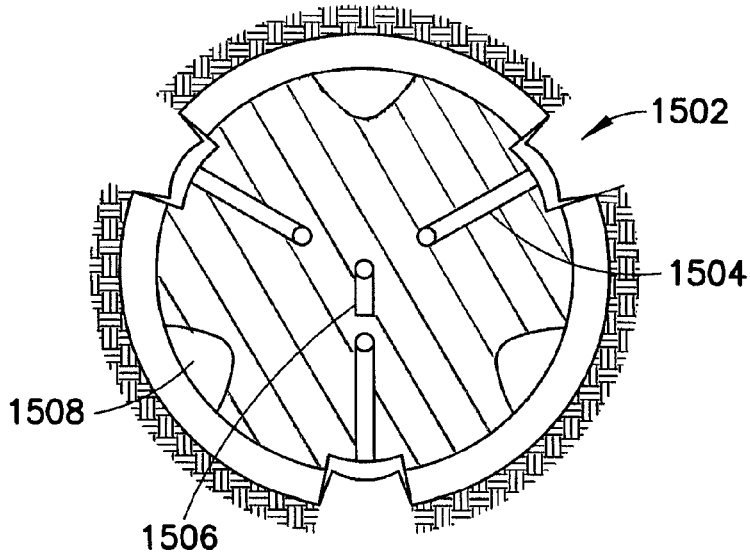

FIGS. 15 and 16 illustrate a drill bit (1500) with hydrostatic pressure pockets (1502) which operate as a bias steering feature. This feature operates in substantially the same manner as the hydrostatically biased steering system of FIGS. 13 and 14. However, in this embodiment the hydrostatic pressure pockets are disposed in the drill bit itself, rather than higher on the BHA. The hydrostatic pressure pockets utilize mud pressure to generate lift on a selected side of the bit in order to push the bit in a desired direction. A pressurized mud fluid film between the pressure pocket and the formation can support large forces with little or no wear. In the illustrated embodiment the drill bit includes three pressure pockets (1502), however as few as one pressure pocket might be utilized. Each pressure pocket is equipped with a feed tube (1504) for directing mud into the pocket. A simple and robust steering system can be implemented by positioning a single, geostationary mud supply line (1506) proximate to the drill bit such that the supply line provides pressurized mud to each feed tube in sequence as the drill bit rotates. Since the mud supply line is geostationary, the drill bit will steer away from the direction of flow of the mud supply line. Linear drilling can be accomplished by synchronizing rotation of the mud supply line with drill bit rotation. The mud operated hydrostatic bearing can additionally provide a dampening effect, due to squeeze-film dampening for example, resulting in a smoother drilling operation. Cut-out features (1508) provide a pathway for the mud flow with cuttings.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. Apparatus for facilitating drilling operations, comprising:

a drillstring segment adapted to be inserted into a borehole, the borehole defined with a bearing surface;

the drillstring segment including a cavity capable of carrying a pressurized fluid and a plurality of steering pads, each steering pad comprising at least one hydrostatic bearing being defined with a bearing land and at least one pocket, the bearing land and the pocket configured to be separated from the bearing surface by a gap; and the drillstring segment capable of utilizing the pressurized fluid to provide a film of fluid in the gap between the hydrostatic bearing of each steering pad and the bearing surface, so as to reduce friction between the hydrostatic bearing and the bearing surface.

2. The apparatus of claim 1 wherein the drillstring segment comprises a rotary steerable system having the plurality of steering pads.

3. The apparatus of claim 1 wherein the hydrostatic bearing includes a single pressure pocket.

4. The apparatus of claim 1 wherein the hydrostatic bearing includes a plurality of pressure pockets.

5. The apparatus of claim 1 wherein the pressurized fluid is provided by a central mud flow.

6. Apparatus for facilitating steerable drilling of a borehole, comprising:

a bottom hole assembly having a rotary steerable system coupled to a drill bit, the bottom hole assembly further comprising a body having a cavity capable of carrying a pressurized fluid, the rotary steerable system including a plurality of steering pads with at least one hydrostatic bearing feature located in each steering pad, the at least one hydrostatic bearing feature being capable of utilizing the pressurized fluid to provide a film of fluid between the steering pad and a bearing surface during steering of the bottom hole assembly.

7. The apparatus of claim 6 further including at least one kickpad that is movable relative to the bottom hole assembly body, the hydrostatic bearing being disposed on the kickpad.

8. The apparatus of claim 6 further including means for selectively changing pressure in a pocket of the bearing.

9. The apparatus of claim 8 wherein the pressure changing means includes a variable flow restrictor having a restrictor component that can be eccentrically displaced inside an outer cylinder, the outer cylinder having a radially drilled hole fluidically connected to the bearing.

10. The apparatus of claim 9 including multiple bearings, and wherein the restrictor component is adapted to be selectively oriented in a common axis with the outer cylinder such that flow resistance relative to each bearing is equal.

11. The apparatus of claim 6 wherein the hydrostatic bearing feature includes a single pressure pocket.

12. The apparatus of claim 6 wherein the hydrostatic bearing feature includes a plurality of pressure pockets.

13. The apparatus of claim 6 wherein the pressurized fluid is provided by a central mud flow.

14. A method for facilitating drilling operations, comprising stricter:

providing a drillstring segment adapted to be inserted into a borehole, the borehole defined with a bearing surface;

providing a film of fluid between the bearing surface and a radially movable steering pad having at least one hydrostatic bearing being defined with a bearing land and at least one pocket, the bearing land and the pocket configured to be separated from the bearing surface by a gap, and the drillstring segment including a cavity capable of carrying a pressurized fluid and which is adapted to be inserted into the borehole; and directing at least some of the pressurized fluid to the gap between the at least one hydrostatic bearing and the bearing surface via a passage through the radially movable steering pad so as to reduce friction between the hydrostatic bearing and the bearing surface.

15. The method of claim 14 wherein the drillstring segment comprises a rotary steerable system having a plurality of the radially movable steering pads with the at least one hydrostatic bearing in each of the radially movable steering pads.

16. The method of claim 14 including forming a single pressure pocket with the hydrostatic bearing.

17. The method of claim 14 including forming a plurality of pressure pockets with the hydrostatic bearing.

18. The method of claim 14 including providing the pressurized fluid from a central mud flow.

19. A method for facilitating steerable drilling of a borehole, comprising:

providing a bottom hole assembly having a rotary steerable system coupled to a drill bit, the bottom hole assembly further comprising a body having a cavity capable of carrying a pressurized fluid, the rotary steerable system including a plurality of steering pads with at least one hydrostatic bearing feature located in each steering pad; and utilizing the pressurized fluid to provide a film of fluid in the gap between the at least one hydrostatic bearing feature located in each steering pad and the bearing surface so as to reduce friction between the hydrostatic bearing feature and the bearing surface.

20. The method of claim 19 further including selectively changing pressure in a pocket of the bearing.

21. The method of claim 20 further including a variable flow restrictor having a restrictor component and an outer cylinder having a radially drilled hole fluidically connected to the bearing, and including the further step of eccentrically displacing the restrictor component within the outer cylinder.

22. The method of claim 21 including multiple bearings, and including the further step of selectively orienting the restrictor component in a common axis with the outer cylinder such that flow resistance relative to each bearing is equal.

23. The method of claim 19 including forming a single pressure pocket with the hydrostatic bearing.

24. The method of claim 19 including forming a plurality of pressure pockets with the hydrostatic bearing.

25. The method of claim 19 including providing the pressurized fluid from a central mud flow.

* * * * *